US012637915B1

(12) United States Patent
Khathami et al.

(10) Patent No.: US 12,637,915 B1
(45) Date of Patent: May 26, 2026

(54) PIPELINE VALVE SYSTEMS AND METHODS

(71) Applicant: Saudi Arabian Oil Company, Dhahran (SA)

(72) Inventors: Tariq A. Khathami, Dammam (SA); Abdullah M. Salma, Dammam (SA); Abdulrahman E. Sayed, Dhahran (SA); Essa I. Alnaimi, Dhahran (SA); Christian M. Canto Maya, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/033,915

(22) Filed: Jan. 22, 2025

(51) Int. Cl.
*E21B 23/01* (2006.01)
*E21B 34/08* (2006.01)

(52) U.S. Cl.
CPC ..... *E21B 23/01* (2013.01); *E21B 34/08* (2013.01); *E21B 2200/05* (2020.05)

(58) Field of Classification Search
CPC ..... E21B 23/01; E21B 34/08; E21B 2200/05
See application file for complete search history.

(56) References Cited

U.S. PATENT DOCUMENTS 2,352,612 A * 7/1944 Boynton ..... E21B 34/08 166/239
4,482,013 A * 11/1984 Fulkerson ..... E21B 33/128 175/321
7,640,984 B2 * 1/2010 Vert ..... E21B 34/063 166/291
11,306,562 B1 * 4/2022 Giroux ..... E21B 34/142
11,781,698 B2 10/2023 Fekrmandi et al.
2009/0083922 A1 4/2009 Watson et al.
2011/0290344 A1 * 12/2011 Groesbeck ..... E21B 34/16 137/430
2019/0010772 A1 * 1/2019 Thomas ..... E21B 23/03
2021/0054714 A1 * 2/2021 Nichols ..... E21B 34/063
2023/0235640 A1 * 7/2023 Coronado ..... E21B 33/1293 166/387
2025/0001468 A1 1/2025 Khathami et al.

OTHER PUBLICATIONS

Cordell, "Utility Pigs," Pipeline Pigging Handbook, 3rd Ed., Clarion Technical Publishers, 2003, Chapter 5, pp. 1-14, 14 pages.
Tolmasquim et al., "Design and control of pig operations through pipelines," Journal of Petroleum Science and Engineering, Jul. 2008, 62:102-110, 9 pages.

* cited by examiner

*Primary Examiner* — Yong-Suk (Philip) Ro
(74) *Attorney, Agent, or Firm* — Fish & Richardson P.C.

(57) ABSTRACT

A pipeline valve includes a body section including a bore configured to circulate a pipeline fluid therethrough. The body further includes one or more expandable seals configured to seal against an inner surface of a pipeline. The pipeline valve includes a tail section coupled to the body and including at least one ferromagnetic finger that extends from the tail section. The at least one ferromagnetic finger is configured to magnetically couple to the inner surface of the pipeline in response to a magnetic field generated by at least one magnet positioned on or adjacent an external surface of the pipeline to anchor the tail section to the pipeline. The pipeline valve includes a valve section coupled to the body section and the tail section. The valve section is configured to adjust a flow of the pipeline fluid through the bore.

22 Claims, 7 Drawing Sheets

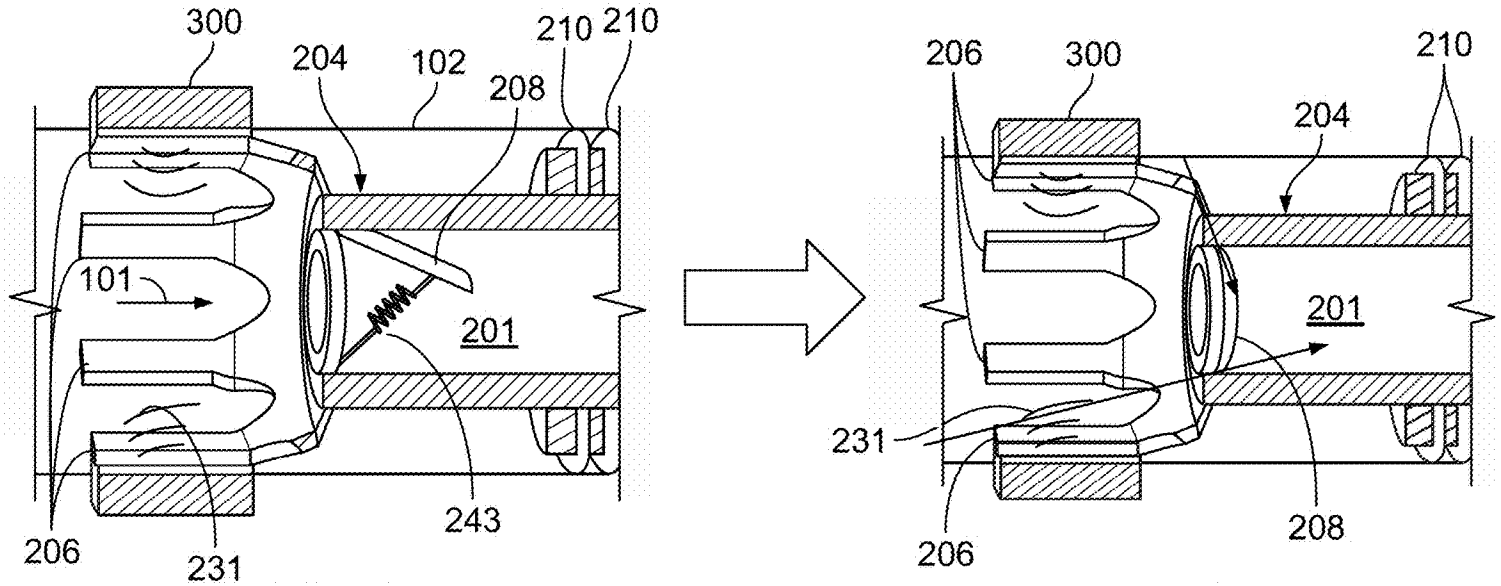
FIG. 4B
FIG. 4A
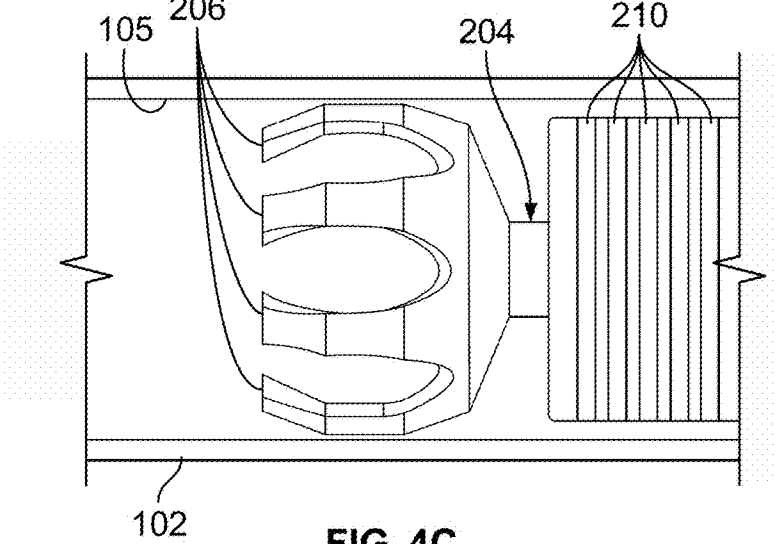
FIG. 4C

PIPELINE VALVE SYSTEMS AND METHODS

TECHNICAL FIELD

This disclosure relates to pipeline valve systems and methods and, more particularly, movable valves for pipeline systems.

BACKGROUND

Valves can be crucial components in fluid control system, widely used across the industries which helps in ensuring unidirectional flow of fluids and gases. For example, a check valve can automatically prevent reverse flow, preventing various units and components from potential damages caused by backflow. Furthermore, modern check valves are designed to control pressure drop and high flow capacity. There are several types of check valves such as swing check valves, ball check valves, and diaphragm check valves, each of which can be tailored to specific needs and operational environments. However, valves are stationary by design and can only be used in their fixed locations and cannot regulate the flow beyond that if an additional flow regulation need was discovered.

SUMMARY

In an example implementation, a pipeline valve includes a body section including a bore configured to circulate a pipeline fluid therethrough. The body further includes one or more expandable seals configured to seal against an inner surface of a pipeline. The pipeline valve includes a tail section coupled to the body and including at least one ferromagnetic finger that extends from the tail section. The at least one ferromagnetic finger is configured to magnetically couple to the inner surface of the pipeline in response to a magnetic field generated by at least one magnet positioned on or adjacent an external surface of the pipeline to anchor the tail section to the pipeline. The pipeline valve includes a valve section coupled to the body section and the tail section. The valve section is configured to adjust a flow of the pipeline fluid through the bore.

In an aspect combinable with the example implementation, the at least one ferromagnetic finger is configured to flex from a first position apart from the inner surface to a second position in contact with the inner surface in response to the magnetic field generated by the at least one magnet positioned on or adjacent the external surface of the pipeline.

In another aspect combinable with one, some, or all of the previous aspects, the first position is an inwardly concave position.

In another aspect combinable with one, some, or all of the previous aspects, the at least one ferromagnetic finger includes a plurality of ferromagnetic fingers radially arranged about the tail section.

In another aspect combinable with one, some, or all of the previous aspects, each of the ferromagnetic fingers is configured to magnetically couple to the inner surface of the pipeline at a unique radially location in response to the magnetic field generated by the at least one magnet positioned on or adjacent the external surface of the pipeline to anchor the tail section to the pipeline.

In another aspect combinable with one, some, or all of the previous aspects, the at least one ferromagnetic finger is configured to detach from the inner surface of the pipeline in response to removal of the magnetic field from the external surface of the pipeline.

In another aspect combinable with one, some, or all of the previous aspects, the body section is configured to move within the pipeline with circulation of the pipeline fluid in the pipeline from a first location in the pipeline in which the tail section is anchored to the pipeline to a second location in the pipeline based on detachment of the at least one ferromagnetic finger from the inner surface of the pipeline at the first location.

In another aspect combinable with one, some, or all of the previous aspects, the one or more expandable seals is configured to seal against the inner surface of the pipeline in response to anchoring the tail section to the pipeline.

In another aspect combinable with one, some, or all of the previous aspects, the body section includes at least one flange that extends circumferentially about the body section.

In another aspect combinable with one, some, or all of the previous aspects, the valve section is integrated within the tail section.

In another aspect combinable with one, some, or all of the previous aspects, the valve section includes a swing check valve configured to allow one-way flow of the pipeline fluid through the valve section.

In another example implementation, a method for controlling flow of a pipeline fluid through a pipeline includes installing a pipeline valve within a pipeline. The pipeline valve includes a body section including a bore and one or more expandable seals configured to seal against an inner surface of the pipeline, a tail section coupled to the body and including at least one ferromagnetic finger that extends from the tail section, and a valve section coupled to the body section and the tail section. The method includes generating a magnetic field with at least one magnet installed on or adjacent an external surface of the pipeline; in response to the generated magnetic field, magnetically coupling the at least one ferromagnetic finger to the inner surface of the pipeline to anchor the tail section to the pipeline; and subsequent to anchoring the tail section to the pipeline, adjusting a flow of a pipeline fluid through the bore with the valve section.

An aspect combinable with the example implementation includes flexing the at least one ferromagnetic finger from a first position apart from the inner surface to a second position in contact with the inner surface in response to the generated magnetic field.

In another aspect combinable with one, some, or all of the previous aspects, the at least one ferromagnetic finger includes a plurality of ferromagnetic fingers radially arranged about the tail section.

Another aspect combinable with one, some, or all of the previous aspects includes in response to the generated magnetic field, magnetically coupling each of the plurality of ferromagnetic fingers to the inner surface of the pipeline at a unique radially location to anchor the tail section to the pipeline.

Another aspect combinable with one, some, or all of the previous aspects includes removing the magnetic field from the external surface of the pipeline; and in response to removing the magnetic field from the external surface of the pipeline, detaching the at least one ferromagnetic finger from the inner surface of the pipeline.

Another aspect combinable with one, some, or all of the previous aspects includes moving the body section within the pipeline with circulation of the pipeline fluid in the pipeline from a first location in the pipeline in which the tail section is anchored to the pipeline to a second location in the pipeline based on detachment of the at least one ferromagnetic finger from the inner surface of the pipeline at the first location.

Another aspect combinable with one, some, or all of the previous aspects includes sealing the body section against the inner surface of the pipeline with the one or more expandable seals in response to anchoring the tail section to the pipeline.

In another aspect combinable with one, some, or all of the previous aspects, the valve section includes a swing check valve, the method including facilitating one-way flow of the pipeline fluid through the valve section.

In another example implementation, a valve system includes a pipeline valve that includes a body section including a bore configured to circulate a pipeline fluid therethrough; a tail section coupled to the body and including at least one ferromagnetic member that extends from the tail section, the at least one ferromagnetic member configured to magnetically couple to an inner surface of the pipeline in response to a magnetic field to anchor the tail section to the pipeline; and a valve section coupled to the body section and the tail section, the valve section configured to adjust a flow of the pipeline fluid through the bore. The valve system includes an external magnetic assembly configured to mount to the pipeline section and generate the magnetic field with at least one magnet.

In an aspect combinable with the example implementation, the at least one magnet includes at least one permanent magnet or at least one electromagnet.

In another aspect combinable with one, some, or all of the previous aspects, the at least one ferromagnetic member includes a plurality of ferromagnetic members.

In another aspect combinable with one, some, or all of the previous aspects, each of the ferromagnetic members is configured to magnetically couple to the inner surface of the pipeline in response to the generated magnetic field to anchor the tail section to the pipeline.

In another aspect combinable with one, some, or all of the previous aspects, the at least one ferromagnetic member is configured to flex in response to the generated magnetic field.

In another aspect combinable with one, some, or all of the previous aspects, the valve section includes a spring and a flapper, the spring configured to urge the flapper to close the bore.

Example implementation according to the present disclosure can include one, some, or all of the following features. For example, a mobile valve according to the present disclosure can provide a valve that is movable, such as by a circulating fluid, within a pipeline or other fluid flow system to one or more desired locations. As another example, a mobile valve according to the present disclosure can provide a valve that can be anchored at multiple locations within a pipeline or other fluid flow system.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

FIGS. 4A-4C are schematic illustrations of an example implementation of a mobile valve in respective anchored and free positions according to the present disclosure.

DETAILED DESCRIPTION

The present disclosure describes piping valve systems and methods, including example implementations of mobile valves that can be transported through a pipeline or piping network and anchored at select or predetermined locations within the pipeline. Once anchored or set at a particular location, example implementations of a mobile valve according to the present disclosure can regulate a flow of a fluid in the pipeline.

Figure 1:
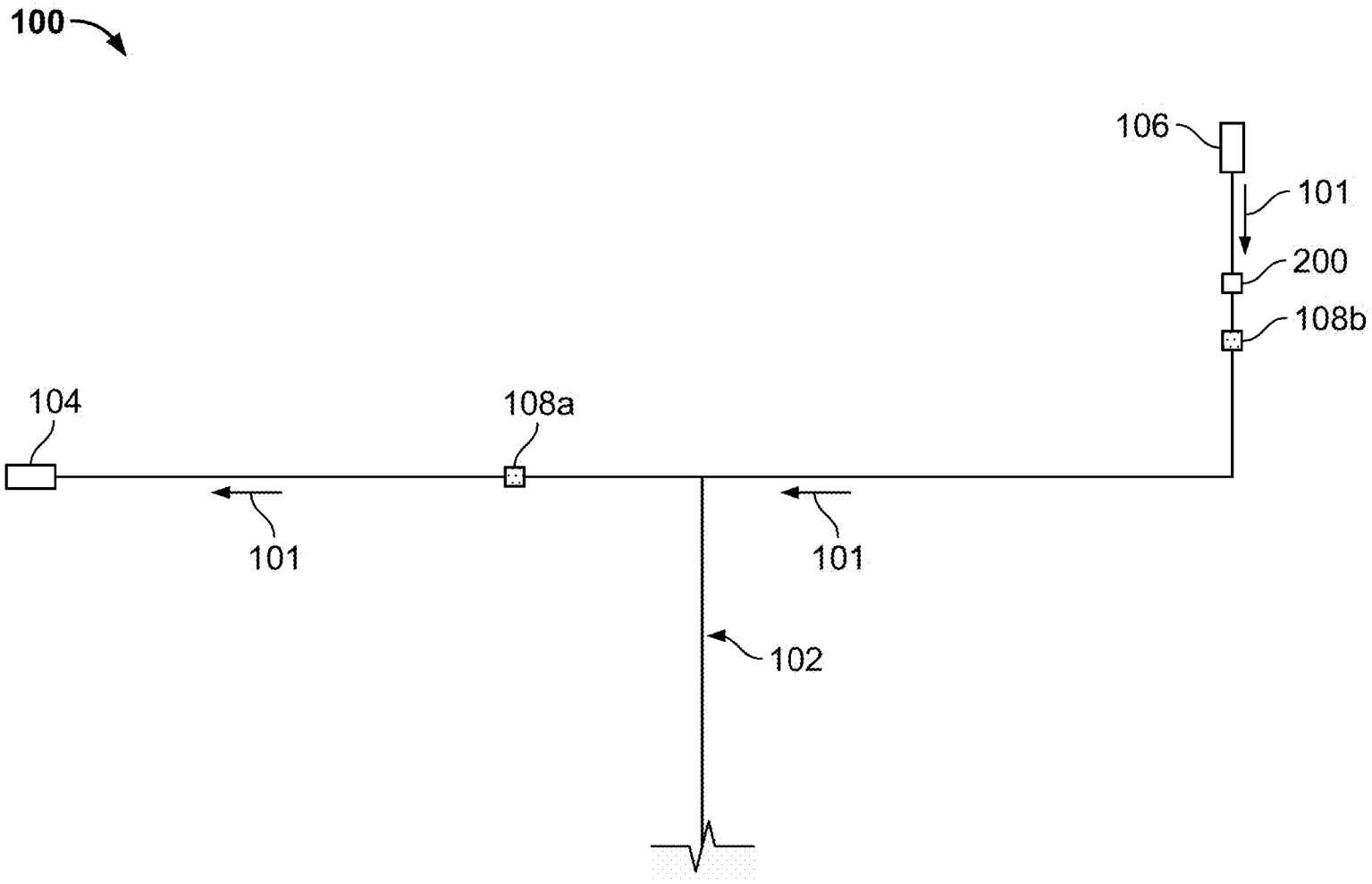
FIG. 1 is a schematic illustration of a pipeline (or piping network) that includes one or more mobile valves according to the present disclosure.

FIG. 1 is a schematic illustration of a piping network 100 that includes one or more mobile valves 200 according to the present disclosure. In this example implementation, the piping network 100 is comprised of one or more fluidly coupled piping sections 102 (which, collectively, can be referred to as a pipeline) through which a fluid 101 (for example, a gas, liquid, mixed-phase, aqueous, hydrocarbon, or other fluid) can be transported (for example, through pumping or natural flow). In the example implementation shown in FIG. 1, the piping network 100 includes a valve entrance 106 (or multiple entrances 106), which, for instance, represents a location or entry point within the pipeline 102 at which a mobile valve 200 can be inserted or installed within the pipeline 102. As further shown, the piping network 100 includes a valve exit 104 (or multiple exits 104), which, for instance, represents a location or exit point within the pipeline 102 at which the mobile valve 200 can be retrieved or taken out of the pipeline 102.

In example implementations and as described in more detail herein, the mobile valve 200 can be set or adjusted into a closed or mobile position in which the mobile valve 200 can be moved or transported through the pipeline 102, such as by flow of the fluid 101. For example, the mobile valve 200 can be inserted into the pipeline 102 at the valve entrance 106 and moved (for example, by circulating the fluid 101) to a valve set location 108*b*. Once moved to the valve set location 108*b* and set in place (as described in more detail herein), the mobile valve 200 can be operated to restrict the flow of the fluid 101 (for example, as a check valve, isolation valve, modulating control valve, or otherwise). The mobile valve 200 can then be moved to another location, such as valve set location 108*a* (through further circulation of the fluid 101). At the valve set location 108*a*, the mobile valve 200 can be operated to restrict the flow of the fluid 101 (for example, as a check valve, isolation valve, modulating control valve, or otherwise). In some aspects, the mobile valve 200 can be removed from the pipeline 102 at the valve exit 104 after being released from the valve set location 108*a*.

Figure 2A:
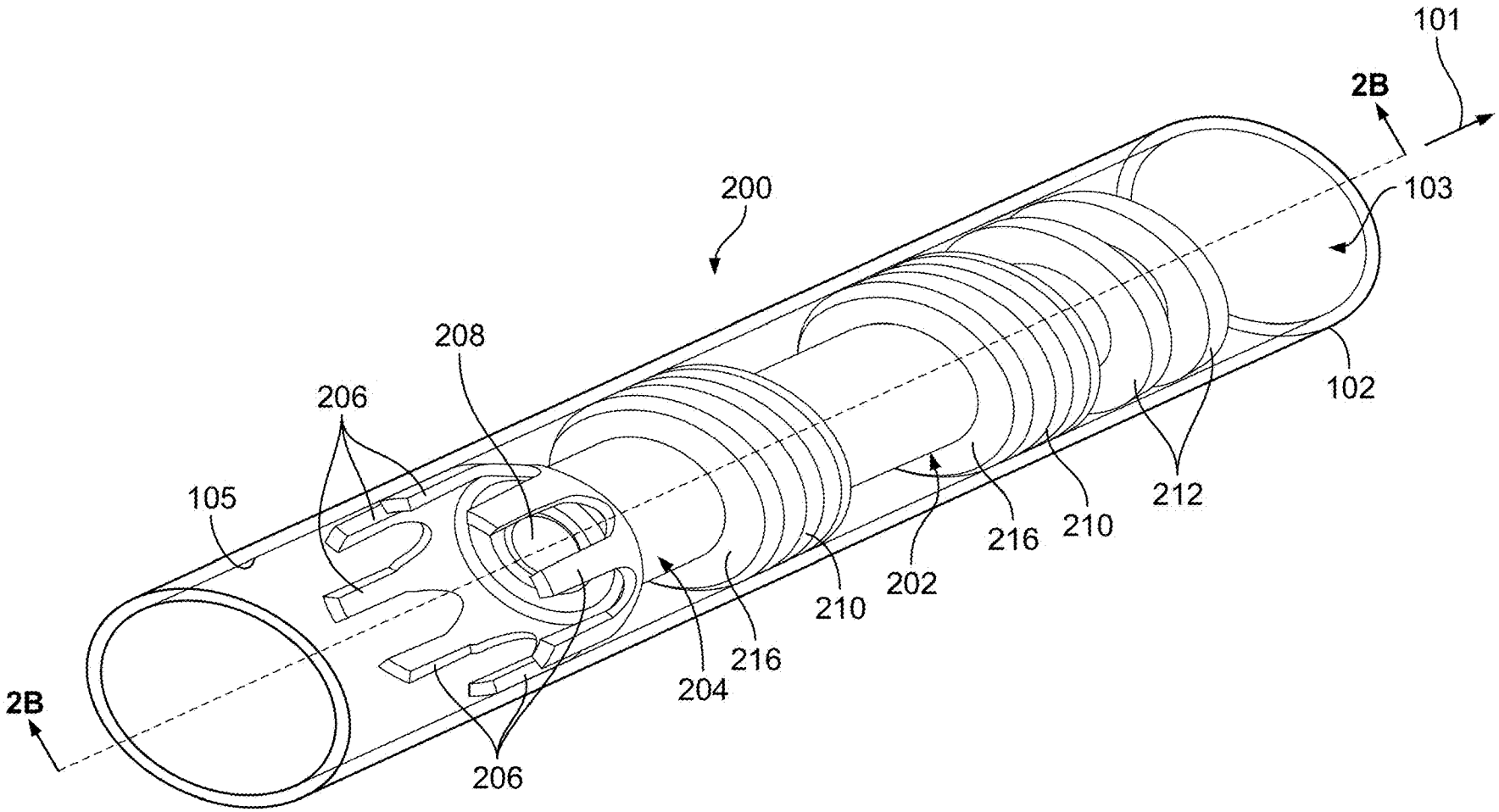
FIGS. 2A and 2B are schematic illustrations of an example implementation of a mobile valve for a pipeline according to the present disclosure.
Figure 2B:
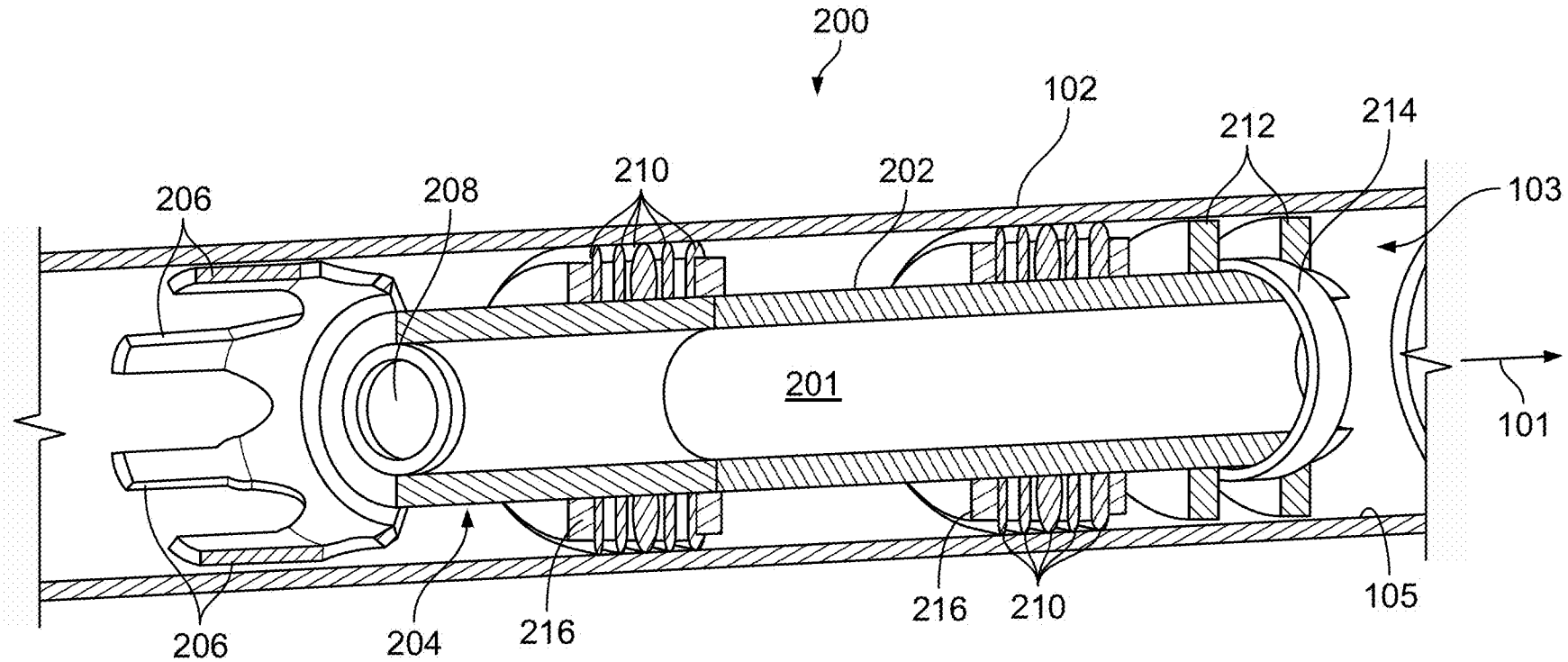

Turning to FIGS. 2A and 2B, these figures show schematic illustrations of an example implementation of a mobile valve for a pipeline according to the present disclosure. For example, mobile valve 200 that can be used in the piping network 100 as described in FIG. 1 is shown (in an example implementation) in FIGS. 2A and 2B. FIG. 2A shows an isometric view of the example mobile valve 200 within the pipeline 102, while FIG. 2B shows an axial cross-section (taken along 2B-2B shown in FIG. 2A) of the mobile valve 200 in the pipeline 102.

As shown in the example implementation of FIGS. 2A and 2B, the mobile valve 200 includes a body section (or, body) 202 and a tail section (or, tail) 204 coupled to the body 202 (for example, integrally, threadingly, or otherwise). Generally, the body 202 and the tail 204 are coupled together and form a bore 201 that facilitates a flow of a fluid (such as fluid 101) therethrough. In operation, the mobile valve 200 can operate to control a flow of the fluid 101 through the bore 201 when the mobile valve 200 is set (for example, semi-permanently or otherwise) at a valve set location within the pipeline 102.

As shown in this example, the body 202 of the mobile valve 200 includes seal rings 216 that extend from the body 202 at, in this example, two axial locations of the body 202. Alternative examples of the mobile valve 200 can include a single seal ring 216 or more than two seal rings 216. In this example, each seal ring 216 includes grooves 217 (shown in FIGS. 3A and 3B), with each groove 217 sized to receive and hold an expandable seal ring 210. As described in more detail herein, each expandable seal rings 210 can be adjusted between a retracted position (with a smaller, first circumference) and an expanded position (with a larger, second diameter) to, for example, help secure the mobile valve 200 at a valve set location within the pipeline 102 and direct fluid flow in the pipeline 102 through the bore 201 (and prevent or help prevent fluid flow radially between the mobile valve 200 and an inner wall of the pipeline 102.

Continuing with FIGS. 2A and 2B, the example body 202 also includes flanges 212 that are connected to or formed as part of the body 202. In this example, there are two flanges 212, which define a groove to define a flexible hollow joint 214, which can provide flexibility to the body 202 in particular piping configurations (such as those with turns or elbows). However, alternative implementations can include more than two flanges 212 (and, for instance, more than one seal ring 214). As described in more detail herein, the flanges 212 create or define a flow surface for the mobile valve 200, which can act to move the mobile valve 200 within the pipeline 102 due to a fluid force created against the flanges 212 by a circulation of the fluid 101. Once set in a valve set location, the seal rings 210 can seal or help seal against a flow of the fluid 101 between the mobile valve 200 and the inner wall of the pipeline 102.

As shown in this example implementation, the tail 204 of the mobile valve 200 includes multiple fingers 206 that extend away from the body 202 and radially about the mobile valve 200. In this example, the mobile valve 200 includes a swing check valve 208 that regulates a flow of the fluid 101 through the bore 201 of the mobile valve 200 once the mobile valve 200 is set at a valve set location in the pipeline 102.

In this example implementation, each finger 206 is comprised of a ferromagnetic material with magnetic properties such that application of a magnetic field (for example, by a magnet applied external to the pipeline 102) can attract the fingers 206 (which can be flexible to bend in response to a magnetic force) against the inner surface 105 of the pipeline 102. More specifically, in this example implementation, the fingers 206 can contain imbedded ferromagnetic material to enable the mobile valve 200 to be set in place in the pipeline 102 through the use of an external magnet (as explained in more detail herein). Other portions of the mobile valve 200, such as the body 202 and other portions of the tail 204, can be formed of a non-ferromagnetic material).

Figure 3B:
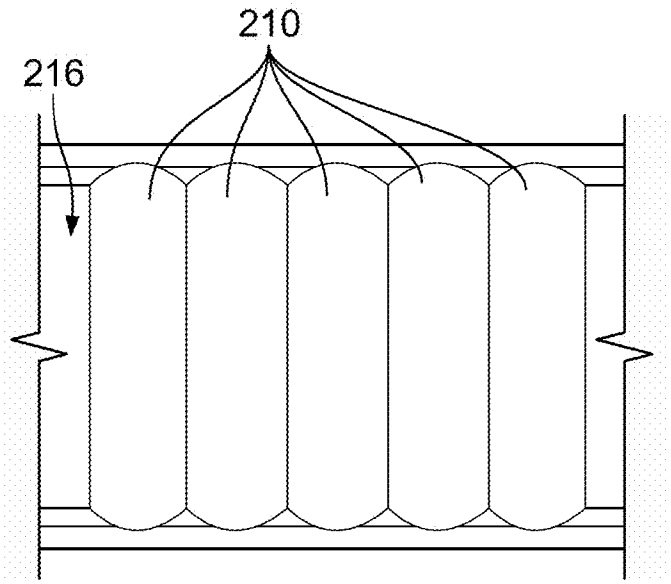
FIGS. 3A and 3B are schematic illustrations of a portion of an example implementation of a mobile valve for a pipeline according to the present disclosure.
Figure 3A:
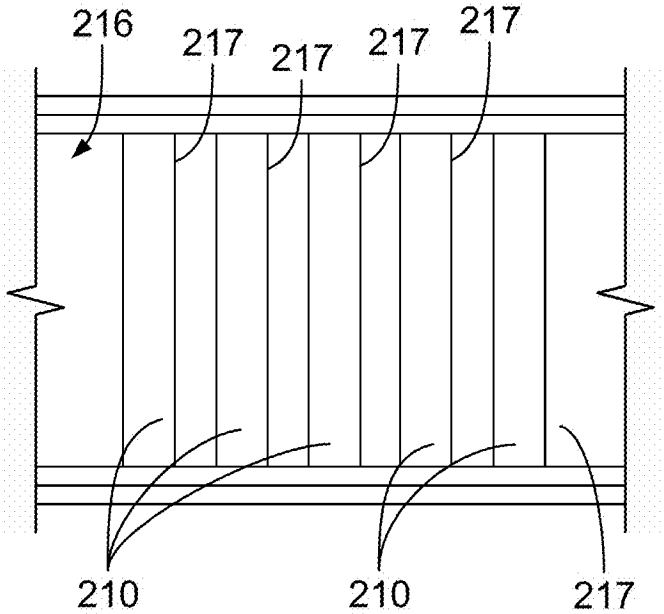

FIGS. 3A and 3B are schematic illustrations of a portion of an example implementation of a mobile valve for a pipeline according to the present disclosure. FIG. 3A shows the seal rings 216 (or a portion thereof) with the expandable seal rings 210 in a retracted position (in other words, not expanded circumferentially). In this state, the mobile valve 200 can also be considered in a closed position to be moved through the pipeline 102. In a closed position (with the expandable seal rings 210 in the retracted position), the fluid 101 can be circulated through the pipeline 102 without interference between the expandable seal rings 210 and the inner surface 105 of the pipeline 102. Once set at a valve set location in the pipeline 102 (through attraction of the ferromagnetic fingers 206 to a magnet mounted external to the pipeline 102), the expandable seal rings 210 can be adjusted from the retracted position to an expanded position as shown in FIG. 3B. When the mobile valve 200 is set at a stationary position in the pipeline 102, the flow of the fluid 101 can act on the flanges 212 to expand the body 202, thereby allowing the expandable seal rings 210 to increase in circumference (to the expanded position in FIG. 2B). Once expanded, the seal rings 110 contact the inner surface 105 of the pipeline 102, thereby preventing fluid flow between the mobile valve 200 and the pipeline 102 and directing the fluid 101 through the bore 201 of the mobile valve 200.

For example, as the ferromagnetic fingers 206 are held by a magnetic force, which sets the mobile valve 200 in a valve set location in the pipeline 102, a differential pressure is generated due to the flow resistance of the body 202 (for example, the flanges 212). Once a generated differential pressure is high enough, this pressure overcomes the resistance of the body 202 to move, which can cause a telescoping or expansion of the body 202. This movement of the body 202 can expand the expandable seal rings 216 to seal against the inner surface 105 of the pipeline 102. In some aspects, the body 202 can move while the fingers 206 are being held at a set position. Such movement by the body 202 triggers the expansion rings 210, for example by electrical, mechanical, or any other suitable mechanism.

FIGS. 4A-4C are schematic illustrations of an example implementation of a mobile valve in respective anchored and free positions according to the present disclosure. FIG. 4A shows a portion of the mobile valve 200 with the fingers 206 magnetically secured to the pipeline 102 by an external magnet assembly 300, thereby anchoring the mobile valve 200 at a valve set position in the pipeline 102. In FIG. 4A, the swing check valve 208 is in an open position to let fluid 101 into the bore 201 of the mobile valve 200 (thereby placing the movable valve 200 in an open position).

In FIG. 4B, the mobile valve 200 is anchored (as in FIG. 4A) but the swing check valve 208 is in a closed position to prevent fluid 101 from passing through the bore 201 of the mobile valve 200 (thereby placing the movable valve 200 in a closed position). FIG. 4C shows the mobile valve 200 with the fingers 206 retracted from the inner surface 105 of the pipeline 102 (due to removal of the external magnet assembly 300), thereby releasing the mobile valve 200 from the valve set position in the pipeline 102 and allowing the mobile valve 200 to move (with fluid 101) through the pipeline 102. The swing check valve 208 can continue being in the closed position until the set fluid pressure is met, which will overcome the gate resistance and open the gate, which allows fluid to enter the mobile valve 200.

Note that this pressure set point of the gate must be higher than the pressure needed to move 202 which triggers the expansion rings. Otherwise, another triggering mechanism that does not depend on pressure should be used to trigger the expansion rings as in previous comment above.

In an example implementation, the external magnet assembly 300 can include or be comprised of one or more magnets that can be coupled (for example, attached or positioned adjacent) to an external surface of the pipeline 102 at a particular location, such as at one of the valve set locations of the pipeline 102. As the mobile valve 200 moves through the pipeline 102 (in a closed position as shown in FIG. 4C), the fingers 206 remain in a bent (or inwardly concave) position as shown in FIG. 4C). Upon reaching the one or more magnets that are coupled (for example, attached) to the pipeline 102, the fingers 206 become magnetically attracted to the one or more magnets (by a magnetic field 231 generated by the external magnet assembly 300) and bend radially toward the inner surface 105 of the pipeline 102 due to the magnetic attraction between the fingers 206 and the one or more magnets.

The magnets of the external magnet assembly 300 can be electromagnets, permanent magnets, or any other suitable magnet type. Permanent magnets can be used as the a relatively low temperature fluid 101 (such as less than 100° C.) flows through the pipeline 102. If the magnets are permanent magnets, the permanent magnets can be turned on and off through the use of a magnetic switch. If the magnets are electromagnets, an electric current can be provided to the electromagnets. Electric current provided to the electromagnets activates the electromagnets and induces the magnetic field 231 in the magnets. When the electric current is no longer supplied to the magnets, the magnets 116 can be deactivated so that the mobile valve 200 is released from being anchored to the pipeline 102.

In some aspects, a strength of magnetic attraction generated by the external magnet assembly 300 can be determined (and selected) based on a number of considerations. For example, a distance between the magnet(s) in the assembly 300 and the fingers 206, which depends on the diameter of the pipeline 102 (and size of mobile valve 200) can be a consideration. Also, a crush strength of the fingers 206 can be a consideration. Also, a viscosity of the fluid 101 can be a consideration. Further, a specific permeability of the ferromagnetic fingers 206 can be a consideration. There can be multiple techniques to accurately find the needed electromagnetic force that will generate the needed pulling force to hold the mobile valve 200 at a valve set location. For example, such a force can be calculated theoretically by using derivatives of Maxwell equations. Also, such a force can be determined experimentally in a controlled environment that simulates the conditions where the mobile valve 200 is intended to be installed in a pipeline.

With reference to FIGS. 4A-4C, in a closed (valve) position, no external magnetic force acts on the tail 204 and the fingers 206 are concave inward (as shown in FIG. 4C). This position (concave inward) can minimize resistance to movement of the mobile valve 200 by a circulating fluid 101. However, once the mobile valve 200 shifts into an open (valve) position at a valve set location in the pipeline 102 (shown in FIGS. 4A and 4C) due to an external magnetic force generated by the external magnet assembly 300, the flexibility of the ferromagnetic fingers 206 can enable them to extend radially outward toward the inner surface 105 of the pipeline 102, which can maximize contact between the surface 105 and the fingers 206 (thereby holding the mobile valve 200 in the valve set location).

Once anchored at the valve set location, the mobile valve 200 (in this example, as a swing check valve) can operate to regulate a flow of the fluid 101. For example, as shown in FIG. 4A, the mobile valve 200, as a swing check valve, can include a spring 243 (or other biasing member) that acts to retain the swing check valve (and specifically, its flapper or gate) in a closed position (shown in FIG. 4B). When a fluid pressure of the fluid 101 acts on the flapper or gate with a high enough force to overcome a spring force of the spring 243, the flapper or gate can open to allow fluid flow through the mobile valve 200 (in a direction from left to right as shown in FIG. 4A). If the fluid flow reverses (right to left in FIG. 4A), the spring 243 acts to close the gate or flapper, thereby closing the mobile valve 200 to fluid flow.

Figure 5A:
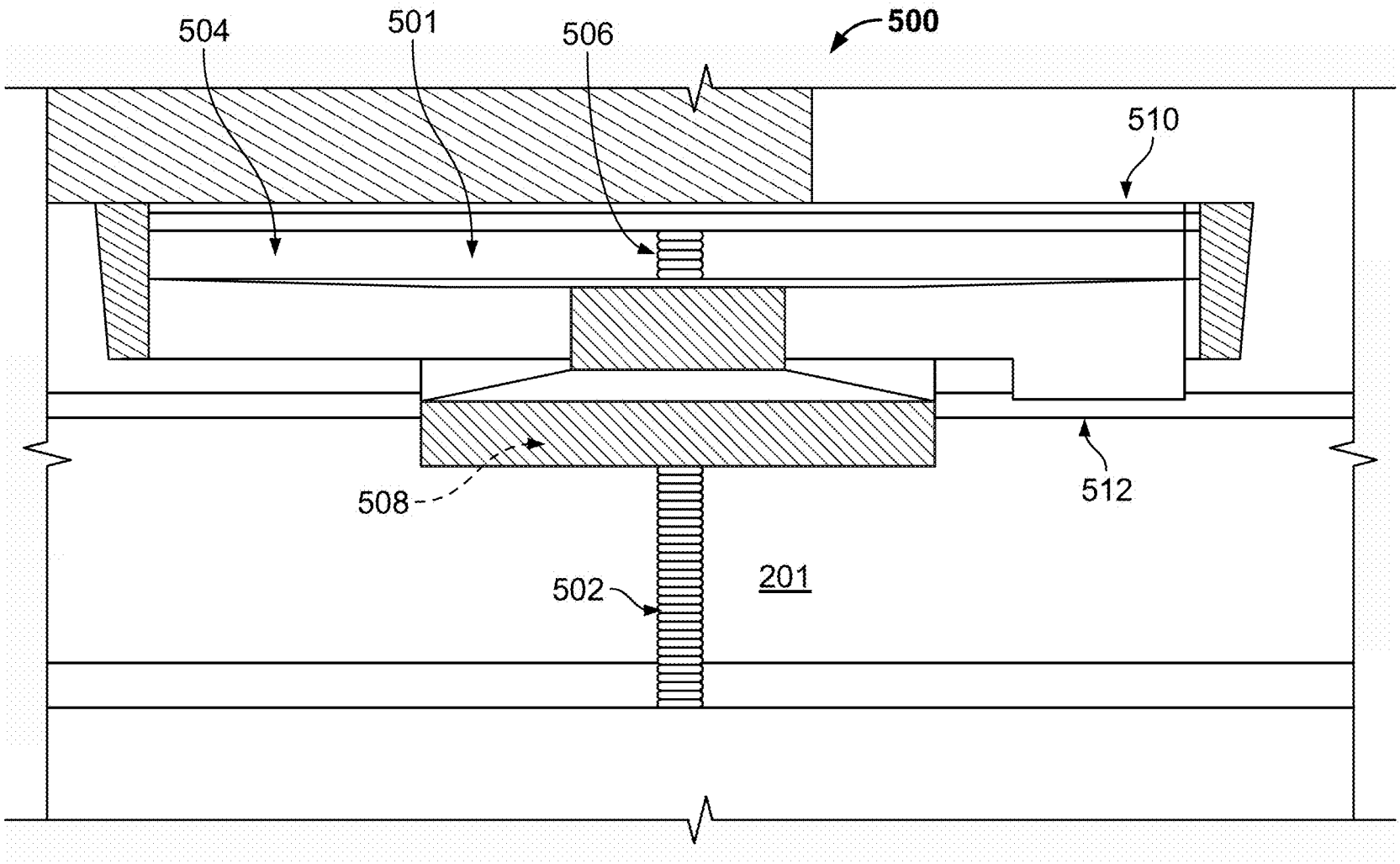
FIGS. 5A and 5B show an example implementation of a portion of a mobile valve as a pressure reducing valve according to the present disclosure.
Figure 5B:
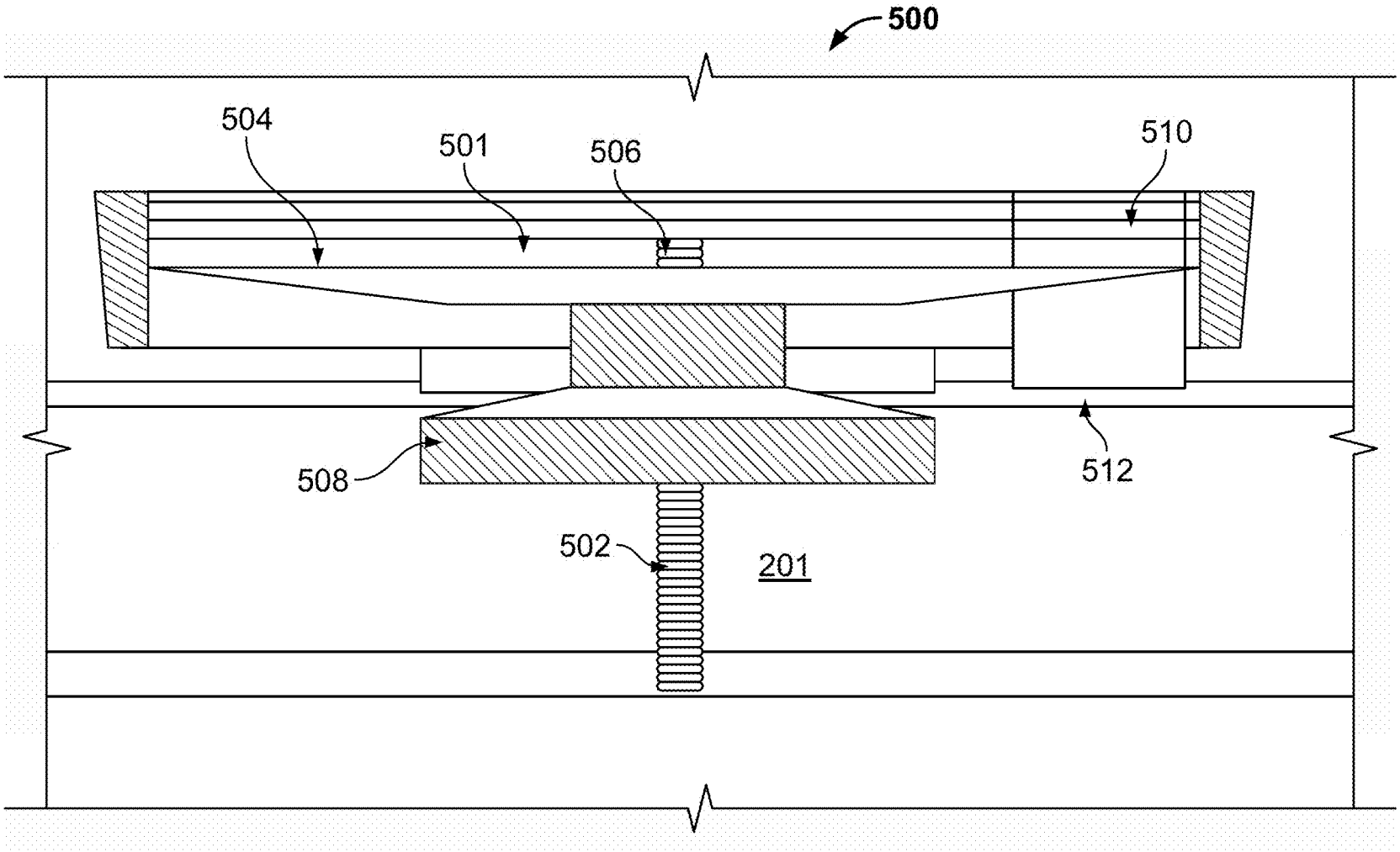

The mobile valve 200 can also be designed as another type of valve, while still including the body 202 and tail 204 as described. For example, the mobile valve 200 can be a piston valve, a control valve, a butterfly valve, a ball valve, a gate valve, or a diaphragm valve. Another example is a pressure reducing valve. Turning briefly to FIGS. 5A and 5B, these figures show an example implementation of a portion of a movable valve as a pressure reducing valve according to the present disclosure. As shown in these figures, a valve section 500 can be implemented in the mobile valve 200, such as within one of or between the body 202 and the tail 204. Thus, valve section 500 can represent a pressure reducing valve section that works with the body 202 and tail 204 previously described.

Valve section 500, in this example, includes a spring 502 that threadingly couples (through the bore 201) to an adjustable disk 508. A spring 506 is threadingly coupled to a diaphragm 504 within a pressure adjusting chamber 501 of the valve section 500. A ferromagnetic plate 510 encloses the pressure adjusting chamber 501 and is coupled to the diaphragm 504 through the spring 506. When the mobile valve 200 including the valve section 500 is anchored at a valve set position in the pipeline 102, the ferromagnetic plate 510 can be controlled by, for example, one or more magnets or an external magnet assembly 300 as described herein.

FIG. 5A shows the valve section 500 (as a pressure reducing valve) in a closed position, while FIG. 5B shows the valve section 500 in an open position. In order to adjust the valve section 500 from the closed to open position, the ferromagnetic plate 510 can be controlled by one or more external magnets to adjust the springs 506 and 502. As the magnetic pulling force used is stronger the spring 506 can be compressed further to cause the valve section 500 to be opened further and increase a reduction in pressure. In some aspects, the valve section 500 can be adjusted between a 100% closed and a 100% open position, such as 20%, 30%, 50%, 75% open, depending on an electromagnet pulling force, which can be manipulated by alternating the electrical current applied to the one or more external magnets.

While this specification contains many specific implementation details, these should not be construed as limitations on the scope of any inventions or of what can be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

A number of implementations have been described. Nevertheless, it will be understood that various modifications can be made without departing from the spirit and scope of the disclosure. For example, example operations, methods, or processes described herein can include more steps or fewer steps than those described. Further, the steps in such example operations, methods, or processes can be performed in different successions than that described or illustrated in the figures. Accordingly, other implementations are within the scope of the following claims.

What is claimed is:

1. A pipeline valve, comprising:

a body section comprising a bore configured to circulate a pipeline fluid therethrough, the body further comprising one or more expandable seals configured to seal against an inner surface of a pipeline;

a tail section coupled to the body and comprising at least one ferromagnetic finger that extends from the tail section, the at least one ferromagnetic finger configured to magnetically couple to the inner surface of the pipeline in response to a magnetic field generated by at least one magnet positioned on or adjacent an external surface of the pipeline to anchor the tail section to the pipeline; and a valve section coupled to the body section and the tail section, the valve section configured to adjust a flow of the pipeline fluid through the bore.

2. The pipeline valve of claim 1, wherein the at least one ferromagnetic finger is configured to flex from a first position apart from the inner surface to a second position in contact with the inner surface in response to the magnetic field generated by the at least one magnet positioned on or adjacent the external surface of the pipeline.

3. The pipeline valve of claim 2, wherein the first position is an inwardly concave position.

4. The pipeline valve of claim 1, wherein the at least one ferromagnetic finger comprises a plurality of ferromagnetic fingers radially arranged about the tail section, each of the ferromagnetic fingers configured to magnetically couple to the inner surface of the pipeline at a unique radially location in response to the magnetic field generated by the at least one magnet positioned on or adjacent the external surface of the pipeline to anchor the tail section to the pipeline.

5. The pipeline valve of claim 1, wherein the at least one ferromagnetic finger is configured to detach from the inner surface of the pipeline in response to removal of the magnetic field from the external surface of the pipeline.

6. The pipeline valve of claim 5, wherein the body section is configured to move within the pipeline with circulation of the pipeline fluid in the pipeline from a first location in the pipeline in which the tail section is anchored to the pipeline to a second location in the pipeline based on detachment of the at least one ferromagnetic finger from the inner surface of the pipeline at the first location.

7. The pipeline valve of claim 1, wherein the one or more expandable seals is configured to seal against the inner surface of the pipeline in response to anchoring the tail section to the pipeline.

8. The pipeline valve of claim 1, wherein the body section comprises at least one flange that extends circumferentially about the body section.

9. The pipeline valve of claim 1, wherein the valve section is integrated within the tail section.

10. The pipeline valve of claim 9, wherein the valve section comprises a swing check valve configured to allow one-way flow of the pipeline fluid through the valve section.

11. A method for controlling flow of a pipeline fluid through a pipeline, comprising:

installing a pipeline valve within a pipeline, the pipeline valve comprising:

a body section comprising a bore and one or more expandable seals configured to seal against an inner surface of the pipeline, a tail section coupled to the body and comprising at least one ferromagnetic finger that extends from the tail section, and a valve section coupled to the body section and the tail section;

generating a magnetic field with at least one magnet installed on or adjacent an external surface of the pipeline;

in response to the generated magnetic field, magnetically coupling the at least one ferromagnetic finger to the inner surface of the pipeline to anchor the tail section to the pipeline; and subsequent to anchoring the tail section to the pipeline, adjusting a flow of a pipeline fluid through the bore with the valve section.

12. The method of claim 11, comprising flexing the at least one ferromagnetic finger from a first position apart from the inner surface to a second position in contact with the inner surface in response to the generated magnetic field.

13. The method of claim 11, wherein the at least one ferromagnetic finger comprises a plurality of ferromagnetic fingers radially arranged about the tail section, the method comprising:

in response to the generated magnetic field, magnetically coupling each of the plurality of ferromagnetic fingers to the inner surface of the pipeline at a unique radially location to anchor the tail section to the pipeline.

14. The method of claim 11, comprising:

removing the magnetic field from the external surface of the pipeline; and in response to removing the magnetic field from the external surface of the pipeline, detaching the at least one ferromagnetic finger from the inner surface of the pipeline.

15. The method of claim 14, comprising:

moving the body section within the pipeline with circulation of the pipeline fluid in the pipeline from a first location in the pipeline in which the tail section is anchored to the pipeline to a second location in the pipeline based on detachment of the at least one ferromagnetic finger from the inner surface of the pipeline at the first location.

16. The method of claim 11, comprising sealing the body section against the inner surface of the pipeline with the one or more expandable seals in response to anchoring the tail section to the pipeline.

17. The method of claim 11, wherein the valve section comprises a swing check valve, the method comprising facilitating one-way flow of the pipeline fluid through the valve section.

18. A valve system, comprising:

a pipeline valve, comprising:

a body section comprising a bore configured to circulate a pipeline fluid therethrough;

a tail section coupled to the body and comprising at least one ferromagnetic member that extends from the tail section, the at least one ferromagnetic member configured to magnetically couple to an inner surface of the pipeline in response to a magnetic field to anchor the tail section to the pipeline; and a valve section coupled to the body section and the tail section, the valve section configured to adjust a flow of the pipeline fluid through the bore; and an external magnetic assembly configured to mount to the pipeline section and generate the magnetic field with at least one magnet.

19. The valve system of claim 18, wherein the at least one magnet comprises at least one permanent magnet or at least one electromagnet.

20. The valve system of claim 18, wherein the at least one ferromagnetic member comprises a plurality of ferromagnetic members, each of the ferromagnetic members configured to magnetically couple to the inner surface of the pipeline in response to the generated magnetic field to anchor the tail section to the pipeline.

21. The valve system of claim 18, wherein the at least one ferromagnetic member is configured to flex in response to the generated magnetic field.

22. The valve system of claim 18, wherein the valve section comprises a spring and a flapper, the spring configured to urge the flapper to close the bore.

* * * * *